US008485353B2

(12) United States Patent
Lee et al.

(10) Patent No.: US 8,485,353 B2
(45) Date of Patent: Jul. 16, 2013

(54) CAP ASSEMBLY HAVING STORAGE CHAMBER FOR SECONDARY MATERIAL WITH INSEPARABLE WORKING MEMBER

(76) Inventors: Jeong-Min Lee, Seoul (KR); Seong-Jae Lee, Seoul (KR)

( * ) Notice: Subject to any disclaimer, the term of this patent is extended or adjusted under 35 U.S.C. 154(b) by 430 days.

(21) Appl. No.: 12/311,599

(22) PCT Filed: Dec. 12, 2006

(86) PCT No.: PCT/KR2006/005416

§ 371 (c)(1),
(2), (4) Date: Apr. 2, 2009

(87) PCT Pub. No.: WO2007/069845

PCT Pub. Date: Jun. 21, 2007

(65) Prior Publication Data

US 2010/0163442 A1 Jul. 1, 2010

(30) Foreign Application Priority Data

| | | |
|---|---|---|
| Dec. 12, 2005 | (KR) | 10 2005 0122939 |
| Dec. 12, 2005 | (KR) | 10 2005 0122940 |
| Dec. 12, 2005 | (KR) | 10 2005 0122941 |
| Dec. 12, 2005 | (KR) | 10 2005 0122942 |
| Dec. 19, 2005 | (KR) | 10 2005 0126615 |
| Mar. 18, 2006 | (KR) | 10 2006 0025547 |
| Mar. 21, 2006 | (KR) | 10 2006 0026440 |
| Mar. 27, 2006 | (KR) | 10 2006 0028270 |
| May 1, 2006 | (KR) | 10 2006 0040368 |

(51) Int. Cl.
*B65D 81/32* (2006.01)
*B65D 51/28* (2006.01)

(52) U.S. Cl.
USPC ..... 206/221; 206/219; 215/DIG. 8

(58) Field of Classification Search
USPC ..... 206/222, 219, 568, 221, 220; 215/DIG. 8, 215/250, 227, 228; 220/521, 522
See application file for complete search history.

(56) References Cited

U.S. PATENT DOCUMENTS

| | | | | |
|---|---|---|---|---|
| 4,195,730 | A * | 4/1980 | Hunt | 206/221 |
| 4,386,696 | A * | 6/1983 | Goncalves | 206/221 |
| 5,088,627 | A * | 2/1992 | Musel | 222/145.5 |
| 5,638,968 | A * | 6/1997 | Baron et al. | 215/11.4 |
| 5,860,569 | A * | 1/1999 | Gregoire | 222/129 |

(Continued)

FOREIGN PATENT DOCUMENTS

| | | |
|---|---|---|
| JP | 2001-00185428 | 7/2001 |
| JP | 2003-002350 | 1/2003 |
| WO | WO 03/059774 A2 | 7/2003 |

OTHER PUBLICATIONS

Search Report from Application No. PCT/KR2006/005416, dated Apr. 13, 2007.

*Primary Examiner* — Steven A. Reynolds
(74) *Attorney, Agent, or Firm* — Westman, Champlin & Kelly, P.A.

(57) ABSTRACT

A cap assembly mounted on a neck of a container for containing an ingredient different from that accommodated in the container includes a cap body having an inner housing formed with a chamber for storage of a secondary ingredient and a working member adapted to open a low end opening of the chamber to allow the secondary ingredient in the chamber of the inner housing to be mixed with a primary ingredient in the container. The mixed ingredients may be discharged through an opening.

7 Claims, 14 Drawing Sheets

U.S. PATENT DOCUMENTS

| | | | | |
|---|---|---|---|---|
| 5,875,889 | A * | 3/1999 | Albisetti | 206/221 |
| 5,954,230 | A | 9/1999 | Blette et al. | 222/1 |
| 6,045,254 | A | 4/2000 | Inbar et al. | 366/130 |
| 6,148,996 | A | 11/2000 | Morini | 206/222 |
| 6,230,884 | B1 | 5/2001 | Coory | 206/222 |
| 6,293,433 | B1 * | 9/2001 | Joulia | 222/129 |
| 6,533,113 | B2 * | 3/2003 | Moscovitz | 206/222 |
| 6,854,595 | B2 | 2/2005 | Kiser | 206/222 |
| 6,921,087 | B2 * | 7/2005 | Takahashi et al. | 277/628 |
| 6,962,254 | B2 | 11/2005 | Spector | 206/222 |
| 6,994,211 | B2 * | 2/2006 | Cho | 206/221 |
| 2005/0211579 | A1 * | 9/2005 | Makita | 206/219 |

* cited by examiner

CAP ASSEMBLY HAVING STORAGE CHAMBER FOR SECONDARY MATERIAL WITH INSEPARABLE WORKING MEMBER

CROSS-REFERENCE TO RELATED APPLICATION

The present application is a Section 371 National Stage Application of International patent application Serial No. PCT/KR2006/005416, filed Dec. 12, 2006, and published as WO 2007/069845 on Jun. 21, 2007, in English the content of which is hereby incorporated by reference in its entirety.

TECHNICAL FIELD

The present invention relates to a cap assembly for closing a container and more particularly to a cap assembly having a storage chamber with an inseparable working member for containing a secondary material (ingredient) for example a concentrated liquid or a granule different from a material (ingredient) for example water or a beverage accommodated in a container.

Such a cap assembly is useful in the various industrial fields such as medical, pharmaceutical, cosmetic and etc.

BACKGROUND ART

Generally, when a beverage that requires mixing up a liquid in a container with a granule or a concentrate liquid as additives or secondary ingredients such as carbon dioxide, vitamin powder, etc, it is often necessary that the container has a separate chamber for storage the secondary ingredients.

U.S. Pat. Nos. 6,962,254, 6,230,884 and 6,854,595 disclose such container having a structure for mixing a primary ingredient with a secondary ingredient in a container. However, the containers disclosed in the above patents have not commercially succeeded because of the problems such as inefficiency in a manufacture process, inconvenience in use, etc.

Recently, PCT/EP2002/004523 filed on Jan. 17, 2002 and Japanese Patent Application No. 2001-00185428 filed on Jun. 19, 2001 suggested other structure, but a commercial success is not obtained.

Particularly, the structure disclosed in Japanese Patent Application mentioned above has a problem that a piece cut out from a discharging port fall into a container and a child may swallow it.

Other structure for separate storage of a secondary ingredient in a container also has a problem that the structure could not be adapted to a neck of a conventional bottle.

DISCLOSURE OF INVENTION

Technical Problem

In view of the above, an object of the present invention is to provide a cap assembly having a storage chamber with an integrated working member for containing a secondary ingredient to be conveniently mixed with a primary ingredient in a container.

Another object of the present invention is to provide a cap assembly with a working member or closer which is adapted to conveniently open the storage chamber and container at the same time.

Technical Solution

In order to accomplish the above-mentioned objects, a cap assembly mounted on a neck of a container for containing a ingredient different from that in accommodated in a container according to the present invention, comprising: a cap body having an inner housing formed with a chamber for storage of a secondary ingredient; a working member adapted to open a low end opening of the chamber to allow the secondary ingredient in the chamber of the inner housing to be mixed with a primary ingredient in the container.

The working member is provided in a direction of a passage of the discharged the mixture of the primary and secondary ingredients.

The low end opening is sealed by a lower sealing portion of the working member and is opened when the working member is upwardly moved so that the secondary ingredient may be discharged to the primary ingredient in the container.

BRIEF DESCRIPTION OF THE DRAWINGS

The above objects, other features and advantages of the present invention will become more apparent by describing the preferred embodiments thereof with reference to the accompanying drawings, in which.

BEST MODE FOR CARRYING OUT THE INVENTION

Figure 1:
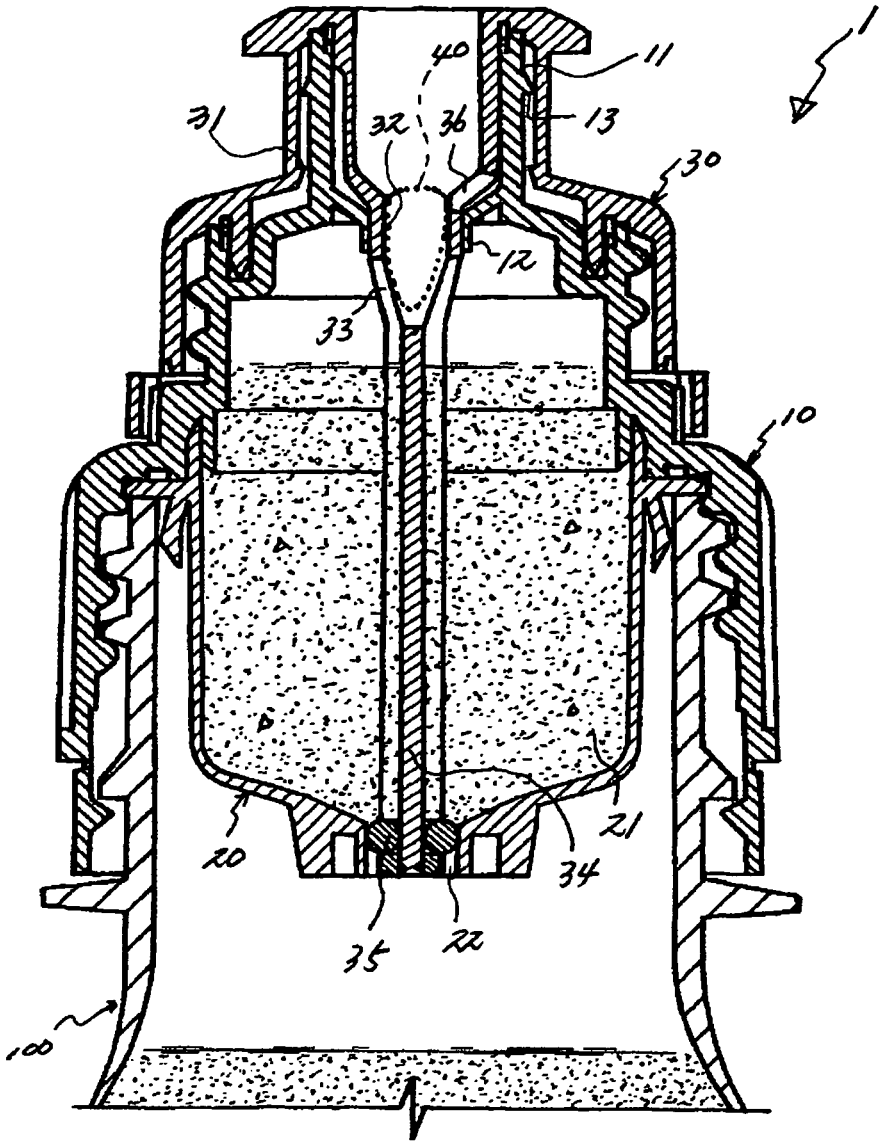
FIG. 1 is a cross-sectional view of cap assembly in accordance with a first embodiment of the present invention.

Reference will now be made to the drawings to describe the resent invention in detail. In the following description of the present invention, the same drawing reference numerals are used for the same elements even in different drawings, and the duplicate explanation thereof will be omitted.

Referring to FIG. 1, a cap assembly 1 in accordance with the preferred embodiment of the present invention may be removably mounted a neck of a container 100 for example a beverage bottle in such a way of a conventional thread engagement, snap-fit engagement or adhering types.

The cap assembly comprises a cap body 10 in an integral or assembling type which includes an inner housing 20 formed with a chamber 21 and lower end opening 22. The cap assembly is provided with a mouth 11 and an upper opening 12. A working member 30 is provided at the mouth for sealingly closing the lower end opening of the inner housing 20.

The working member 30 may be upwardly moved to an opening position by turning or lifting it and FIG. 1 shows the working member which can be opened by turning. There are a stopper 31 at the inner surface of the working member 30 and a stopper 13 at the mouth 11 for limiting the upwardly moving distance of the working member 30.

The working member 30 has an extended part 34, of which the upper end portion 32 and lower sealing portion 35 may sealingly contact with the corresponding inside surfaces of the upper opening 12 and lower end opening 22, respectively, when the working member is assembled in the cap body, so that a leakage of the ingredient contained in the inner housing to the container may be prevented.

A perforated portion 33 is formed below the upper end portion 32, through which a ingredient may be filled into the chamber and then the perforated portion may be sealingly covered a separate closing member 40 or Al film.

An opening 36 is formed above the upper end portion for communicating the chamber to the outside when the working member is moved upwardly.

When a user moves the working member upwardly on the cap body, the upper end portion and lower sealing portion are get out of the sealing contact with the upper opening and low end opening, respectively, whereby the ingredient in the chamber may be dropped to the inside the container to be mixed with the another ingredient therein. At this time, when the user tilts the container and press it, the mixed ingredients may be discharged through the low end opening and opening.

Figure 2:
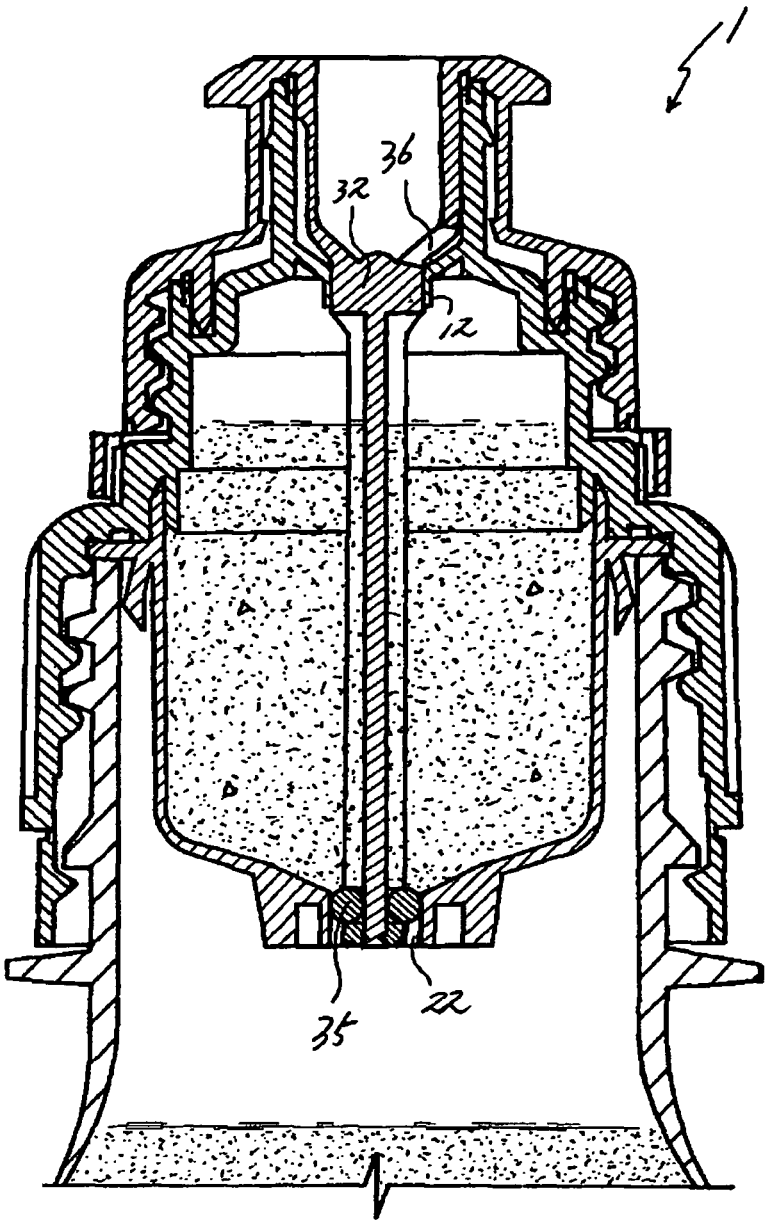
FIG. 2 is a cross-sectional view of cap assembly in accordance with a second embodiment of the present invention.

In the second embodiment shown in FIG. 2, the upper end portion is different from that in FIG. 1 in that the upper end portion has a block shape without the separate closing member 40. When the upper end portion is moved upwardly to get out the sealing contact with the upper opening, the chamber may be communicated through the opening.

In this embodiment of the cap assembly, the ingredient is preferably filled in the inner housing through the low end opening and then the low end opening is blocked with the lower sealing portion.

Figure 3:
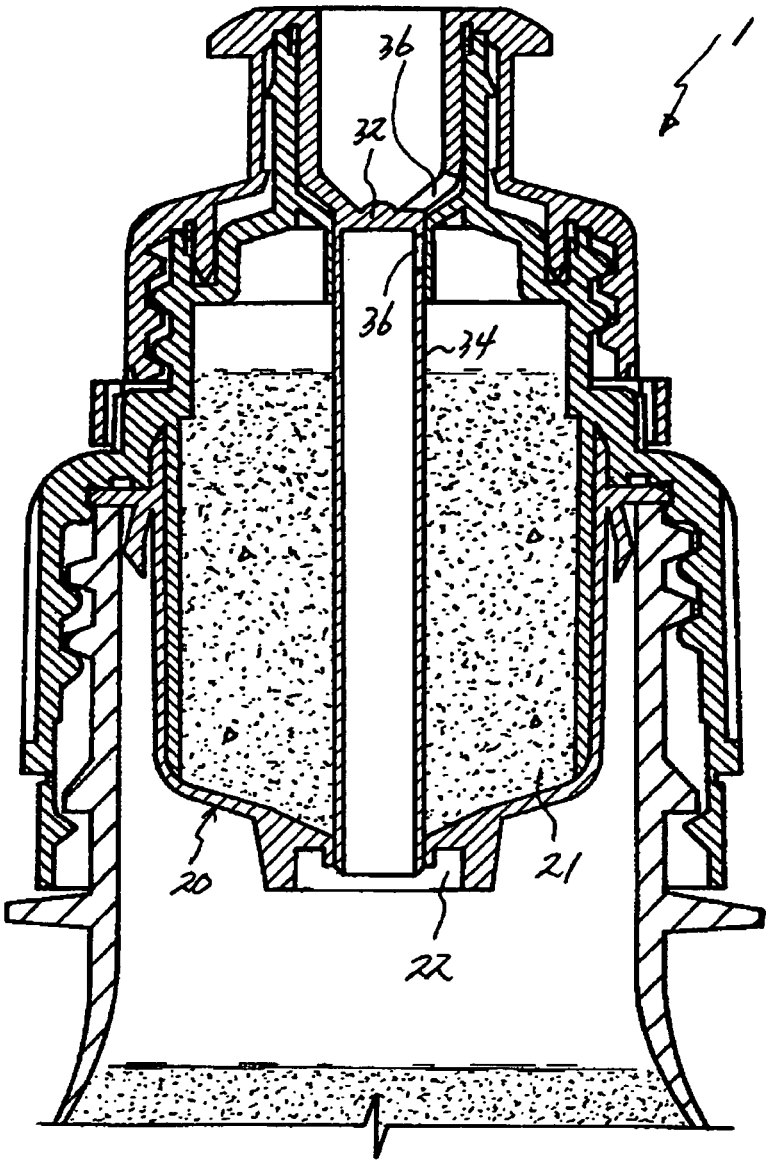
FIG. 3 is a cross-sectional view of cap assembly in accordance with a third embodiment of the present invention.

In the embodiment shown in FIG. 3, the extended part for blocking the low end opening is formed in a cylindrical shape.

Figure 4:
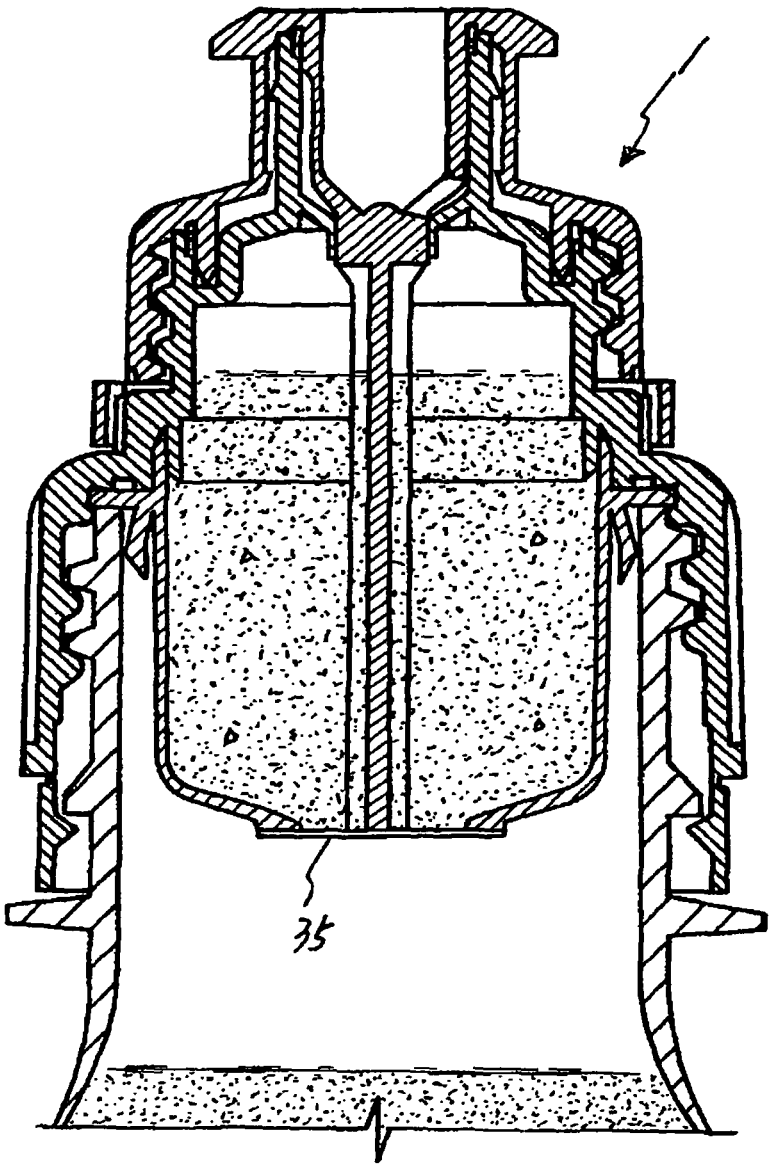
FIG. 4 is a cross-sectional view of cap assembly in accordance with a fourth embodiment of the present invention.

In the embodiment shown in FIG. 4, the lower sealing portion has a sealing member in a film type at the lower end thereof for blocking the low end opening. The sealing member may be ruptured when the extended part together with the working member is moved upwardly and the ingredient in the chamber may be dropped to the inside the container.

Figure 5:
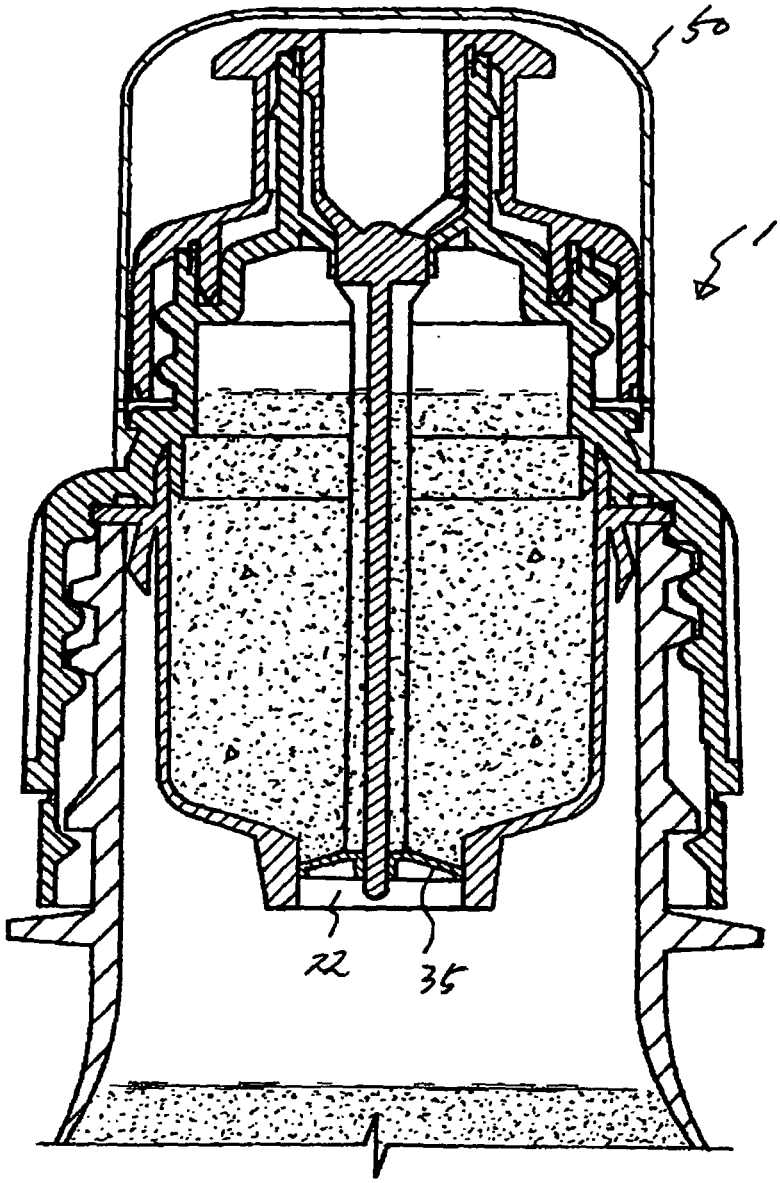
FIGS. 5 to 14 are cross-sectional views of cap assembly in accordance with the various embodiments of the present invention.

The embodiment shown in FIG. 5 has the lower sealing portion in an assembly structure for sealing the low end opening and a cover 50 may be provided over the working member for sanitation.

Figure 6:
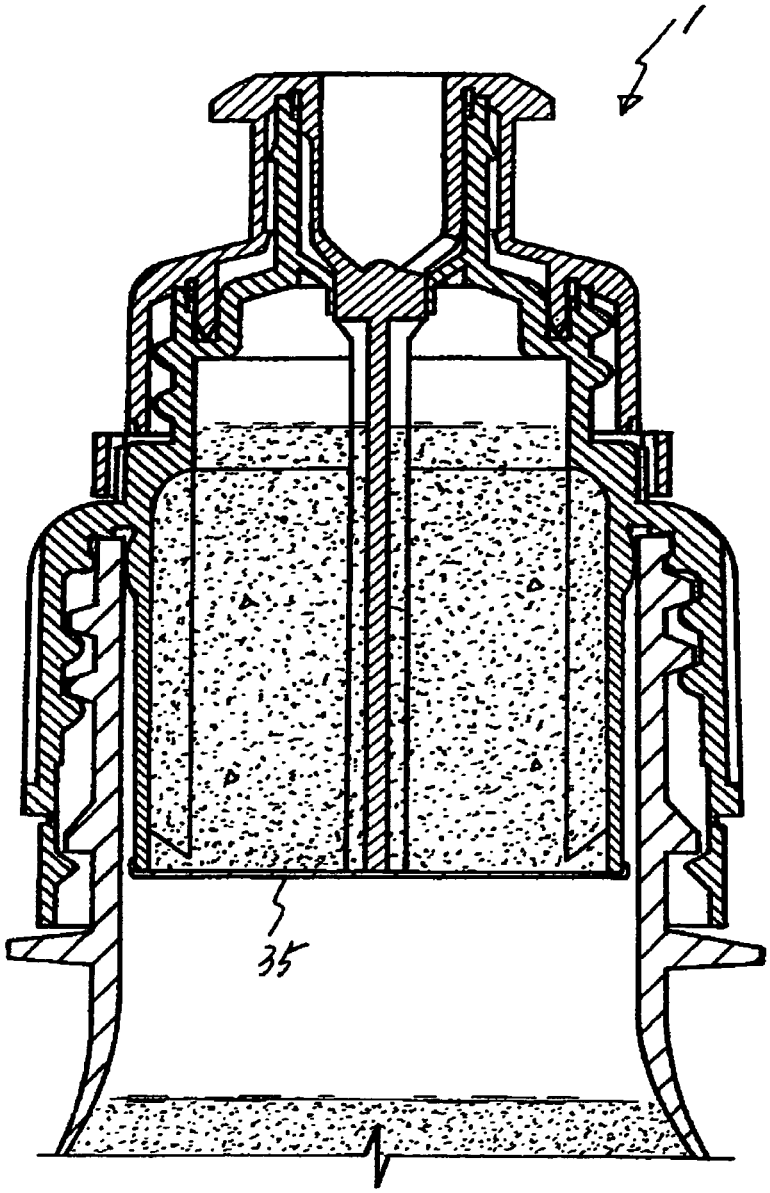

In the embodiment shown in FIG. 6, the inner housing is integrally formed with the cap body.

Figure 7:
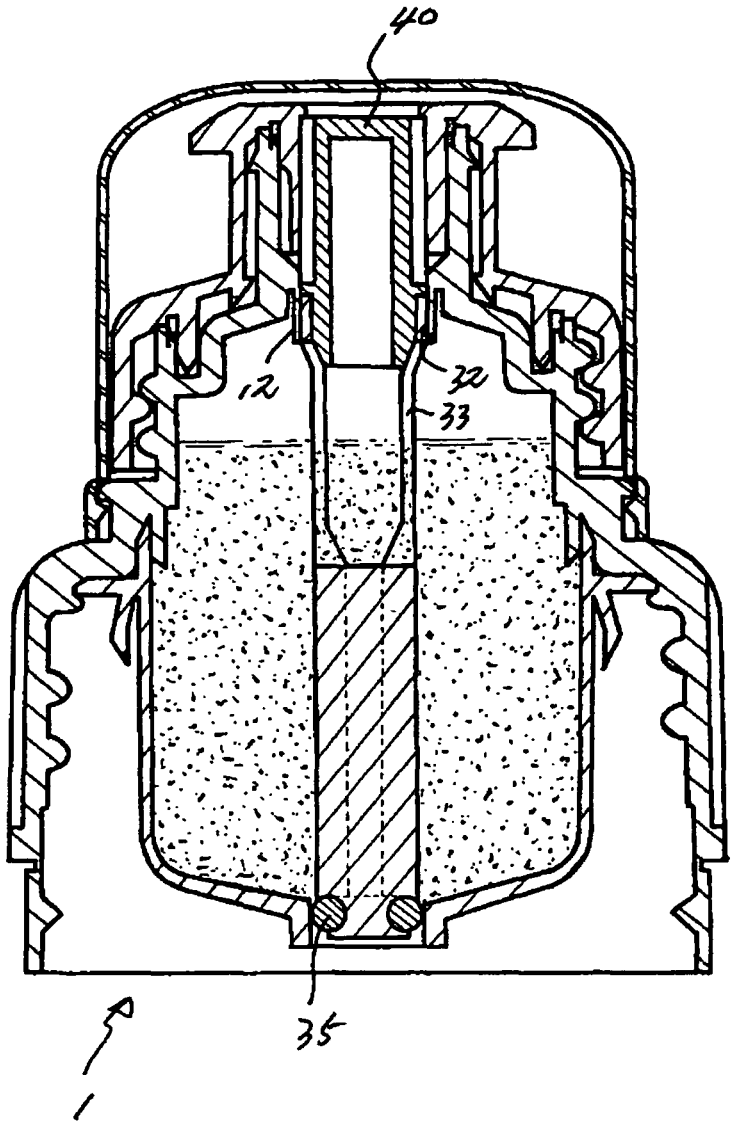

In the embodiment shown in FIG. 7, the 40 is cylindrical shape.

Figure 8:
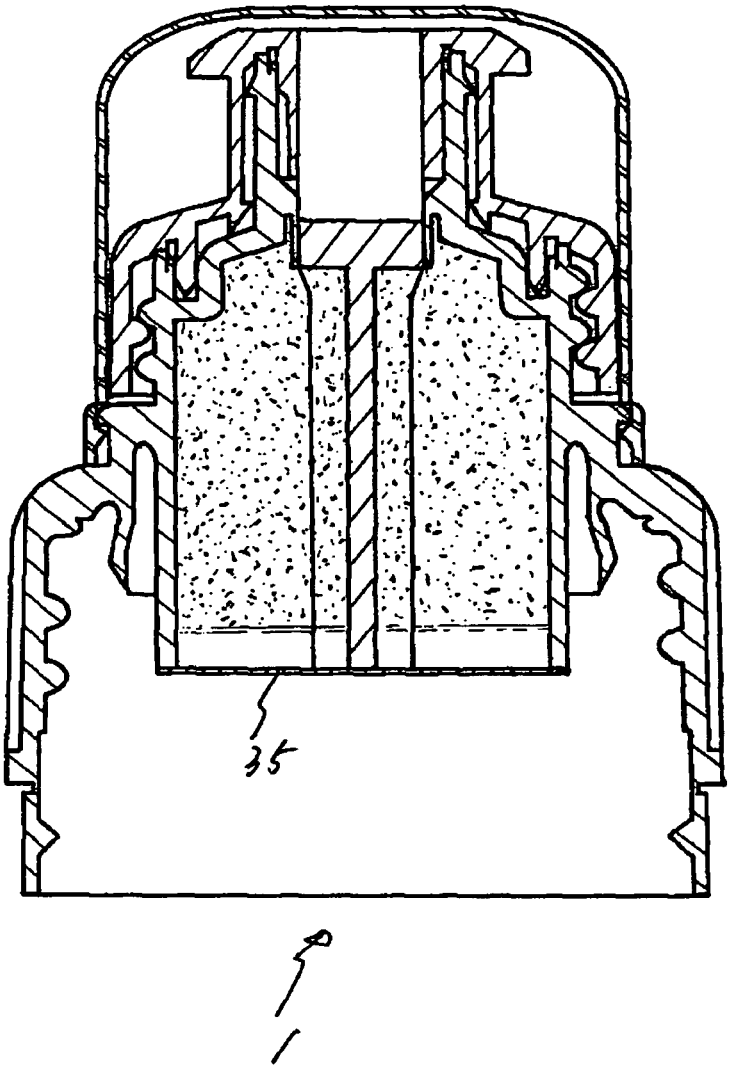

In the embodiment shown in FIG. 8, the inner housing is integrally formed with the cap body in which a cover is provided over the working member for sanitation.

Figure 9:
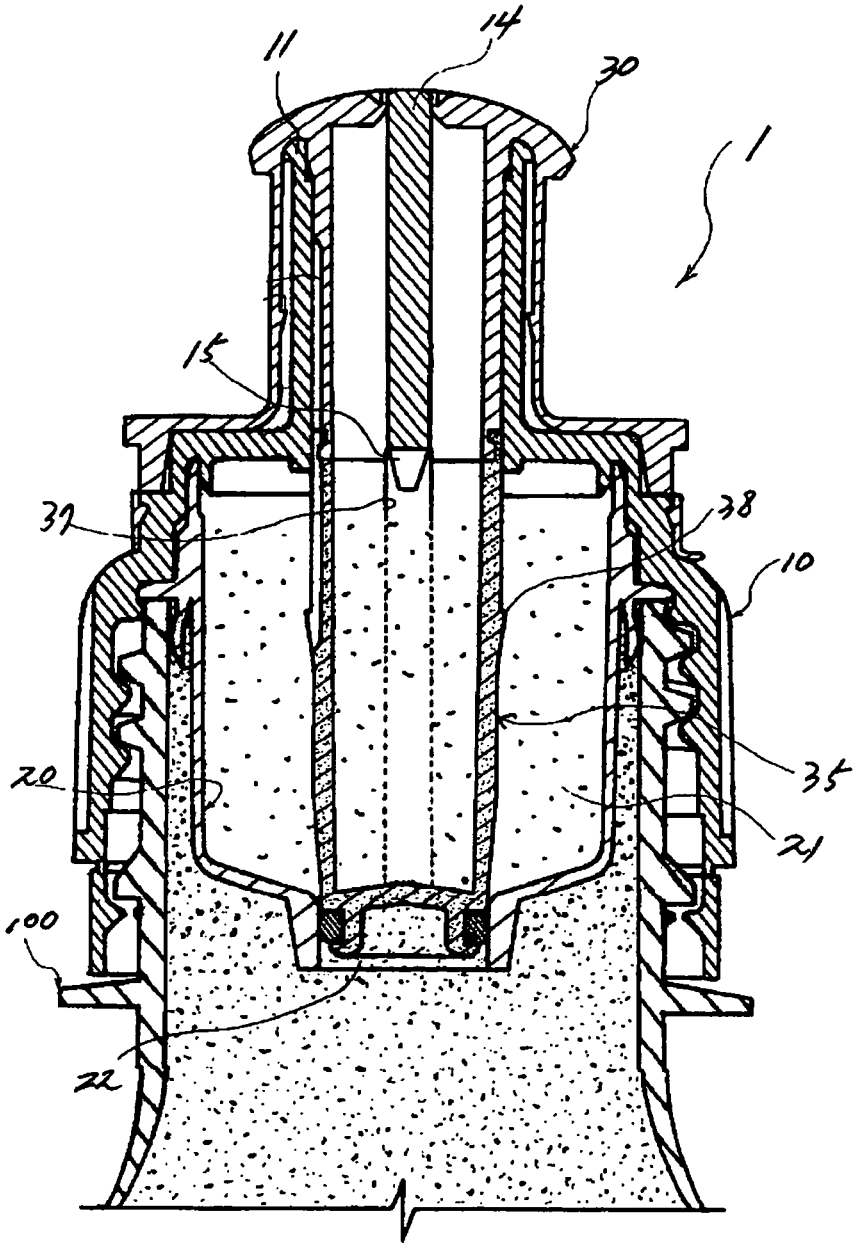

In the embodiment shown in FIG. 9, the low end opening is sealed by the lower sealing portion which is formed as separate cylindrical member and assembled to the extended part. In this embodiment, when the working member is moved upwardly, the lower sealing portion is lifted and the low end opening is opened.

Figure 10:
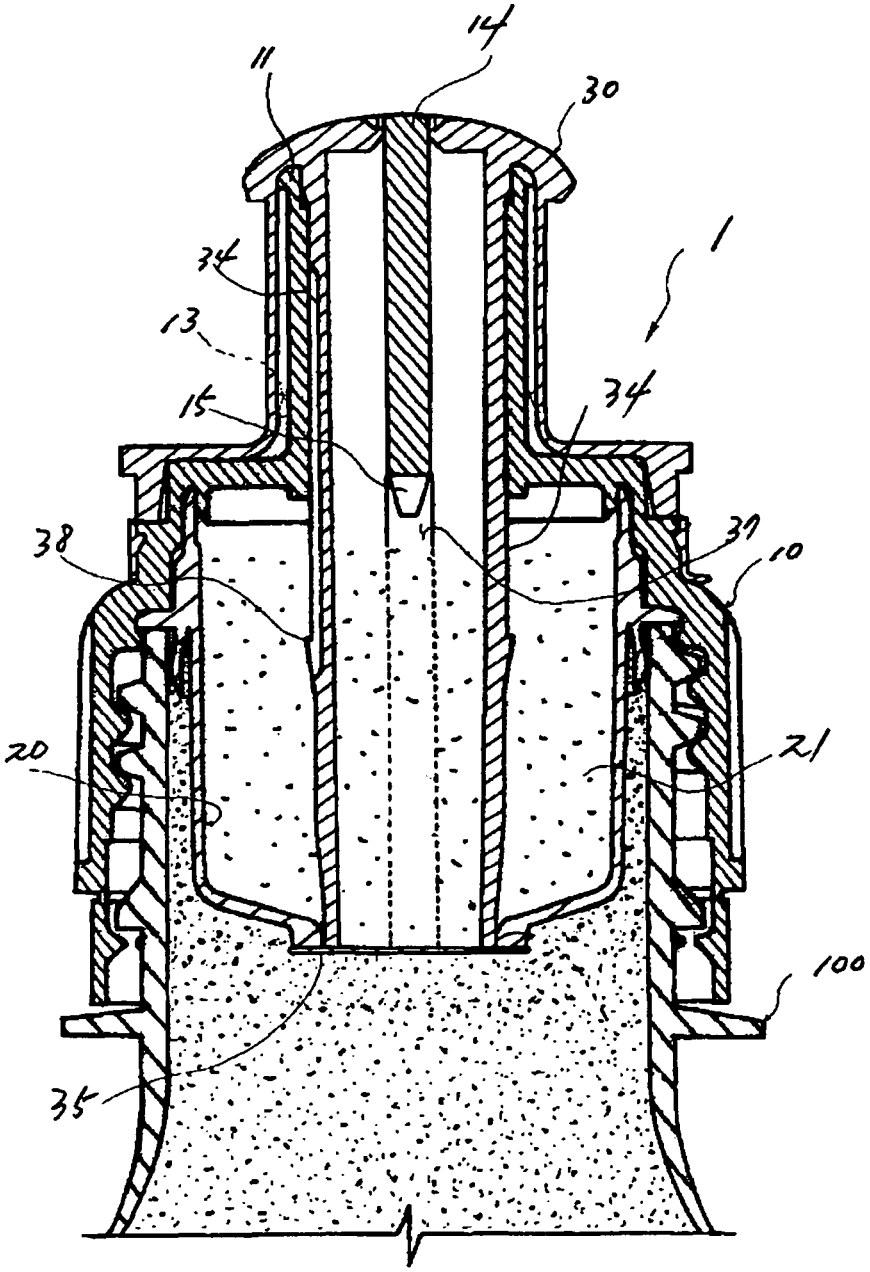

In the embodiment shown in FIG. 10, a long upwardly extended closing member 14 is connected to the cap body by a connecting portion 15. A slit 37 is longitudinally formed at the side wall of the extended part for mounting the working member to pass the closing member. Furthermore, a step 38 is formed at the side wall of the extended part to limit the upward movement of the working member.

Figure 11:
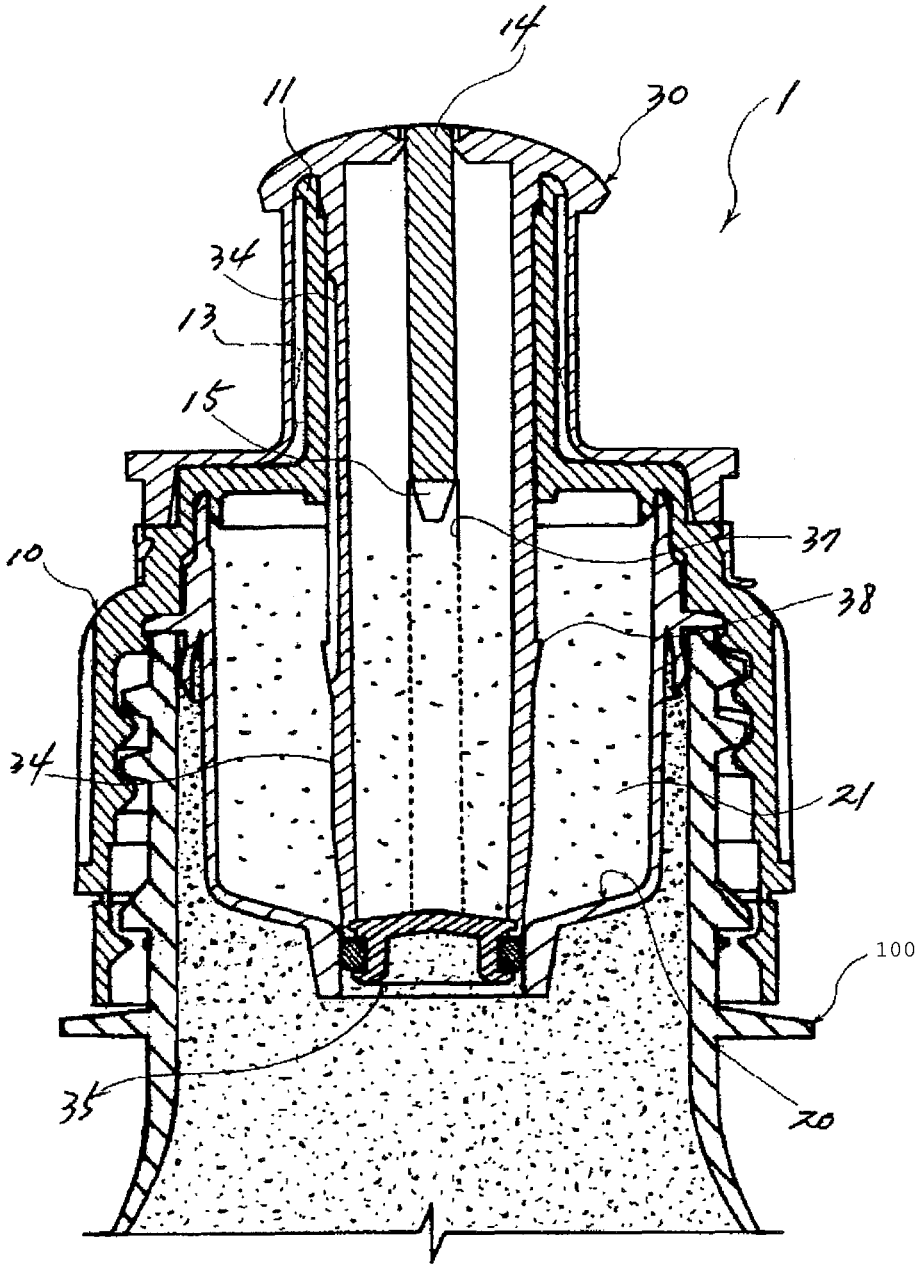

FIG. 11 shows a variant of the lower sealing portion and its assembling at the extended part.

Figure 12:
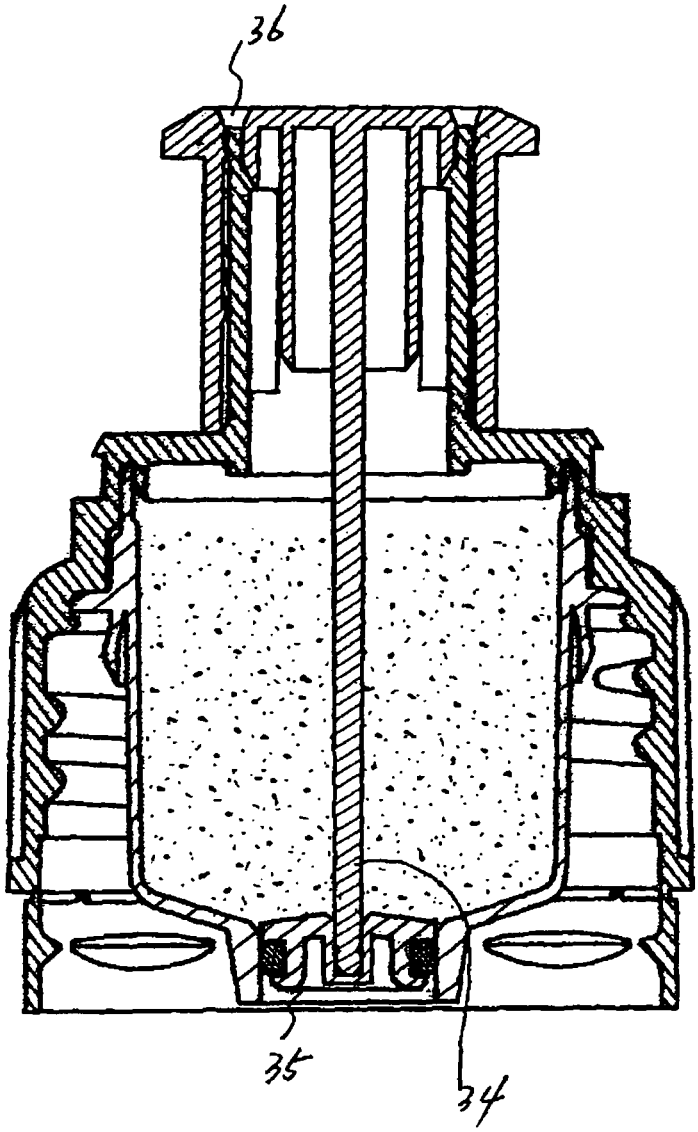

FIG. 12 shows another variant of the lower sealing portion.

Figure 13:
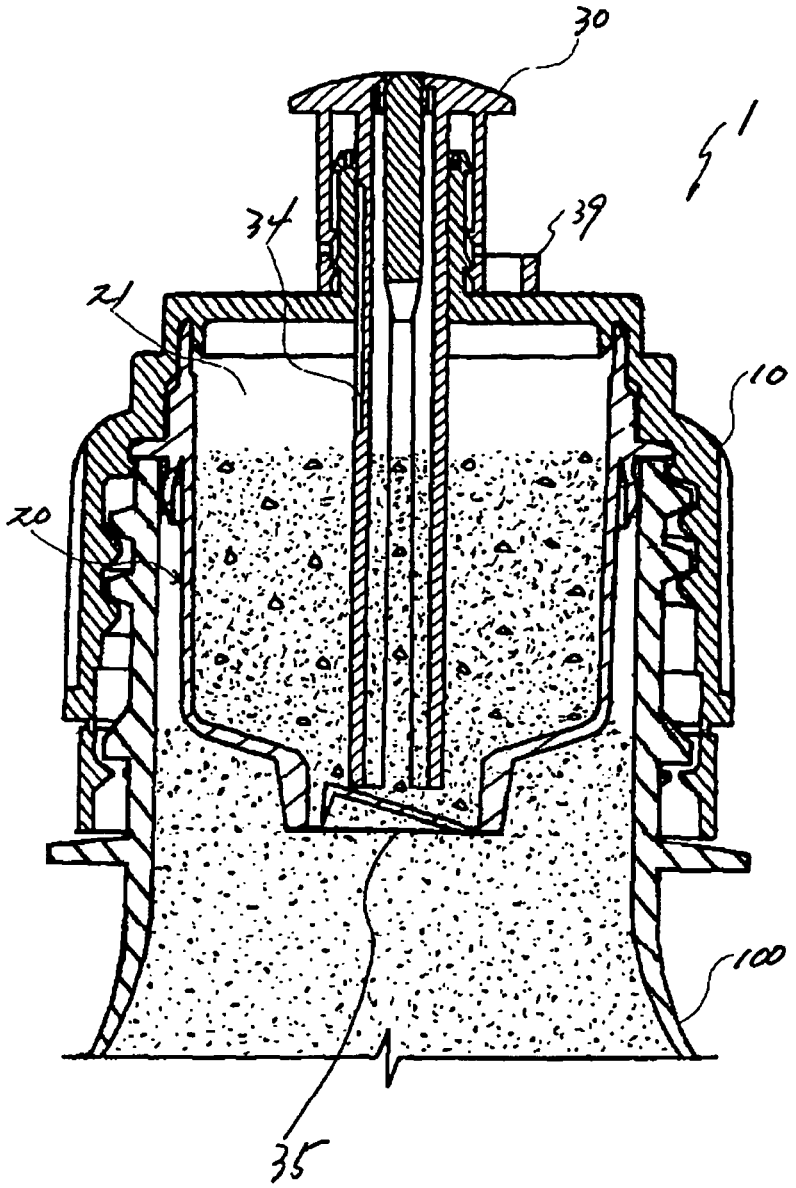

In the embodiment shown in FIG. 13, a skirt 39 formed at the working member is removed and the working member is pushed, whereby a knife member is pressed down to open the lower sealing portion.

Figure 14:
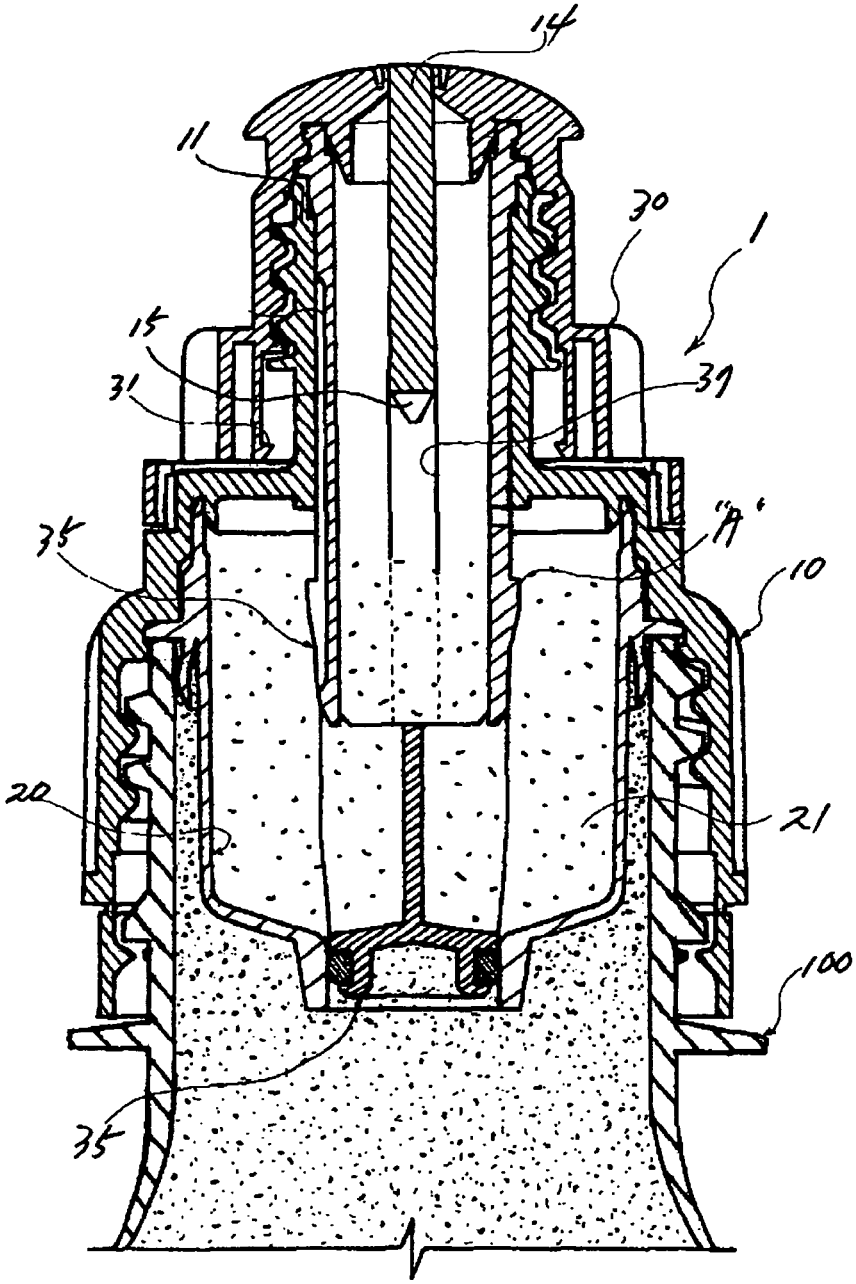

In the embodiment shown in FIG. 14, the lower sealing portion is directly assembled to the working member to be adapted to vertically move together with the working member. The lower sealing portion is downwardly extended to sealingly contact with the low end opening which is opened upon the upward movement of the lower sealing portion with the working member. The working member may be adapted to be upwardly moved or to be rotated.

To limit the upward movement of the lower sealing portion, it is preferable that a stopper 31 may be formed at the outside of the working member or a stopper A may be formed at the lower sealing portion.

The lower sealing portion is fitted to the working member to move vertically with the working member, even if the working member is opened by turning.

INDUSTRIAL APPLICABILITY

As apparent from the above description, the cap assembly of the present invention may be adapted to accommodate a concentrate liquid or a granule to be mixed which a water, a beverage or other liquid in the container with an easy and improved mixing two different materials, which may be advantageous in the various industrial fields such as medical, pharmaceutical, cosmetic and etc.

While the preferred embodiment in accordance with the present invention has been shown and described, equivalent modifications and changes known to persons skilled in the art according to the present invention are considered to be within the scope of the present invention as defined in the appended claims.

The invention claimed is:

1. A cap assembly mounted on a neck of a container for containing an ingredient different from that accommodated in a container, comprising:

a cap body comprising a mouth and an inner housing formed with a chamber, a lower end opening and an upper opening;

a working member adapted to be assembled to the cap body, the working member comprising:

an upper end portion in sealing contact with the upper opening when the working member is in an initial position;

an extended part having a lower end, the extended part extending through the chamber of the inner housing such that the ingredient in the cap assembly is contained between the inner housing and the extended part; and a lower sealing portion provided at the lower end of the extended part to seal the lower end opening when the working member is in the initial position; and when the working member with the extended part is upwardly moved from the initial position, the lower sealing portion is moved out of sealing contact with the lower end opening to drop an ingredient in the chamber into the container so as to be mixed with an another ingredient accommodated in the container to form a mixture and the upper end portion is moved out of sealing contact with the upper opening so that the mixture may be discharged through the upper opening.

2. The cap assembly in accordance with claim 1, wherein said lower sealing portion is formed as a separate part and is assembled to the extended part.

3. The cap assembly in accordance with claim 1, wherein said lower sealing portion is formed as a film type seal member.

4. The cap assembly in accordance with claim 1, wherein said working member assembled to a mouth of the cap body is adapted to be vertically moved to open the low end opening by a long upwardly extended closing member.

5. The cap assembly in accordance with claim 1 wherein the working member further comprises an opening above the upper end portion such that the mixture may be discharged between the working member and the upper opening of the inner housing and then through the opening in the working member when the working member is upwardly moved from the initial position.

6. A cap assembly mounted on a neck of a container for containing an ingredient different from that accommodated in a container, comprising:

a cap body comprising a mouth and an inner housing formed with a chamber, a lower end opening and an upper opening;

a working member adapted to be assembled to the cap body, the working member comprising:

an upper end portion in sealing contact with the upper opening when the working member is in an initial position;

an extended part having a lower end, the extended part extending through the chamber of the inner housing such that the ingredient in the cap assembly is contained between the inner housing and the extended part;

a lower sealing portion provided at the lower end of the extended part to seal the lower end opening when the working member is in the initial position; and an opening above the upper end portion;

such that when the working member with the extended part is upwardly moved from the initial position, the lower sealing portion is moved out of sealing contact with the lower end opening and the upper end portion is moved out of sealing contact with the upper opening so that a mixture may be discharged to the opening in the working member from between the working member and the upper opening and then through the opening in the working member.

7. A cap assembly mounted on a neck of a container for containing an ingredient different from that accommodated in a container, comprising:

a cap body comprising a mouth and an inner housing formed with a chamber, a lower end opening and an upper opening;

a working member adapted to be assembled to the cap body, the working member comprising:

an upper end portion in sealing contact with the upper opening when the working member is in an initial position;

an extended part having a lower end, the extended part extending through the chamber of the inner housing such that the ingredient in the cap assembly is contained between the inner housing and the extended part; and a lower sealing portion provided at the lower end of the extended part to seal the lower end opening when the working member is in the initial position;

wherein a perforated portion is formed below the upper end portion of the extended part, through which an ingredient may be filled into the chamber and then the perforated portion is sealingly covered by a separate closing member; and when the working member with the extended part is upwardly moved from the initial position, the lower sealing portion is moved out of sealing contact with the lower end opening to drop an ingredient in the chamber into the container so as to be mixed with an another ingredient accommodated in the container to form a mixture and the upper end portion is moved out of sealing contact with the upper opening so that the mixture may be discharged through the upper opening.

* * * * *